343-700 MS AU 256 EX
3/2/82 OR 4,318,107

United States Patent [19]

Pierrot et al.

[11] 4,318,107

[45] Mar. 2, 1982

[54] PRINTED MONOPULSE PRIMARY SOURCE FOR AIRPORT RADAR ANTENNA AND ANTENNA COMPRISING SUCH A SOURCE

[75] Inventors: Robert Pierrot; Francois Gautier; Pierre Crochet, all of Paris, France

[73] Assignee: Thomson-CSF, Paris, France

[21] Appl. No.: 96,148

[22] Filed: Nov. 20, 1979

[30] Foreign Application Priority Data

Nov. 24, 1978 [FR] France ..... 78 33292

[51] Int. Cl.[3] ..... H01Q 1/38; H01Q 19/12; H01Q 25/04

[52] U.S. Cl. ..... 343/700 MS; 343/840; 343/854

[58] Field of Search ..... 343/854, 700 MS, 705, 343/708, 765, 778, 16 M, 840

[56] References Cited

U.S. PATENT DOCUMENTS

| | | | |
|---|---|---|---|
| 3,943,523 | 3/1976 | Fassett | 343/854 |
| 3,953,857 | 4/1976 | Jenks | 343/854 |
| 3,965,475 | 6/1976 | Deerkoski et al. | 343/854 |
| 4,089,003 | 5/1978 | Conroy | 343/700 MS |
| 4,142,190 | 2/1979 | Kerr | 343/700 MS |

FOREIGN PATENT DOCUMENTS 2180114 11/1973 France .

OTHER PUBLICATIONS

Drabowitch; Multimode Antennas; Microwave Journal, Jan. 1966, pp. 41–51.
Les Antennes; Thourel; pp. 244–250.

*Primary Examiner*—Eli Lieberman
*Attorney, Agent, or Firm*—Cushman, Darby & Cushman

[57] ABSTRACT

The invention relates to a printed monopulse primary source for a radar antenna.

The primary source has, arranged on a first face of a dielectric material substrate, radiating zones forming independent site and bearing difference and sum channels. A receiving supply circuit for the radiating zones is arranged on a second face of the substrate, opposite to the first face. Connecting means ensure the electrical connection of the radiating zones to the receiving supply circuit in the thickness of the substrate.

Application to airport radar systems.

19 Claims, 11 Drawing Figures

11 IS DIELECTRIC

110 IS A CONDUCTIVE PLATE

PRINTED MONOPULSE PRIMARY SOURCE FOR AIRPORT RADAR ANTENNA AND ANTENNA COMPRISING SUCH A SOURCE

BACKGROUND OF THE INVENTION

The present invention relates in general to printed monopulse primary sources for antennas. The present invention provides a printed monopulse primary source construction that is especially well-suited for use in airborne radar antennas.

Monopulse primary sources generally comprise a radiating circuit including a plurality of radiating elements fed with electromagnetic energy from a feeding-/receiving circuit. The radiating elements are spatially positioned and respectively fed with electromagnetic energy having predetermined phase relationships so as to form a sum channel Σ and one or two difference channels Δ, such as elevation and azimuth difference channels ΔS and ΔG.

Most known monopulse primary sources providing sum and difference channels fall into one of two general types. The first such general type of monopulse source is constructed by associating a plurality of metallic wave guides. Generally, these wave guides have a rectangular cross-section. In one specific case of this first general type, a plurality of over-dimensioned wave guides are associated in which higher order propagation modes are produced. Such construction enables error signals to be generated in the elevation and azimuth planes.

Wave guides sources are difficult to design on paper and even more difficult to fabricate into practical constructions. They are expensive and cumbersome. Their length can be three (3) to ten (10) times the wavelength of the electromagnetic signal to be transmitted or received, depending on the complexity of the source. Wave guide monopulse sources have been described in such publications as "Les Antennes" by L. Thourel published in 1971 by Dunod (see chapter 9) and in "Multi-mode Antennas" by S. W. Drabowich published in the Microwave Journal dated January 1966 (see pp 41-51).

The second general type of known monopulse primary source providing sum and difference channels uses a microstrip printed feeding/receiving circuit. These microstrip printed circuit monopulse sources include microstrip radiating elements. Each radiating element includes a conducting plate positioned over a ground plane and spaced therefrom with a dielectric material. In the prior art, such radiating elements are generally fed by a microstrip circuit including one or more 6λ/4 hybrid junctions grouped on the same side of the dielectric material substrate that carries the radiating elements. Known hybrid circuits are described in U.S. Pat. Nos. 3,921,177—Munson (Nov. 18, 1975) and 3,811,128—Munson (May 14, 1974).

Referring to FIG. 1, there is shown a typical prior art microstrip monopulse source. The source includes four (4) radiating elements A, B, C, and D. The four radiating elements are connected in circuit by four (4) hybrid junctions a, b, c, and d. The radiating elements and hybrid junctions are printed on opposite sides of a double-sided metallized dielectric substrate. The radiating elements A, B, C and D are fed by the hybrid junctions through impedance transformers such as impedance transformer 40.

Output 41 of junction a delivers a signal (A−B) to junction d. Output 42 of junction a delivers the signal (A+B) to junction b. Output 43 of junction c delivers a signal (D+C) to junction b and output 44 of junction c delivers a signal (D−C) to junction d. Outputs 45 and 46 of junction b, supplied respectively by signals (A+B) and (D+C), provide a sum signal $\Sigma=0(A+B)+(C+D)$ and an elevation difference signal $\Delta S=(A+B)-(D+C)$. An output 47 of junction d supplied by signals (D−C) and (A−B) provides the azimuth difference signal $\Delta G=(A-B)+(D-C)-=(A+D)-(B+C)$. Output 48 of junction d is loaded.

Using this known circuit the signal path of sum channel Σ crosses two junctions in cascade thereby incurring a substantial signal loss. In addition, it is possible to obtain undesirable couplings among the channels which degrades performance of the printed monopulse source.

BRIEF SUMMARY OF THE INVENTION

Therefore, the present invention provides a novel construction for a microstrip monopulse source that substantially overcomes many of the limitations of known sources. The printed monopulse source according to the present invention provides independent sum Σ and difference Δ channels using a relatively simple construction that can be manufactured at low cost.

The microstrip monopulse source according to the present invention includes a radiating circuit including a plurality of microstrip radiating elements or "pads", a feeding/receiving circuit fabricated either on a second surface of the dielectric carrying the radiating circuit or on a second dielectric substrate, and connecting means for conducting energy from the feeding/receiving circuit to a predetermined feed point of each radiating element.

The radiating circuit comprises: a dielectric material substrate having first and second faces; a conductive coating provided on a first face of the substrate for forming a ground plane reference; a central microstrip radiating element provided on the second face of the substrate for forming a sum Δ channel; at least one pair of radiating elements provided on the same face of the substrate as the central radiating element and being symmetrical with respect to the central radiating element for supplying, on reception, signals in phase opposition for forming one difference channel; and connecting means for feeding each radiating element at a respective feed point thereof which has a predetermined eccentricity with respect to the zero field radio center of the radiating element in the axis of polarization defined by the eccentricity of the feed point of the central radiating element.

DETAILED DESCRIPTION OF THE PREFERRED EMBODIMENT

Figure 1:
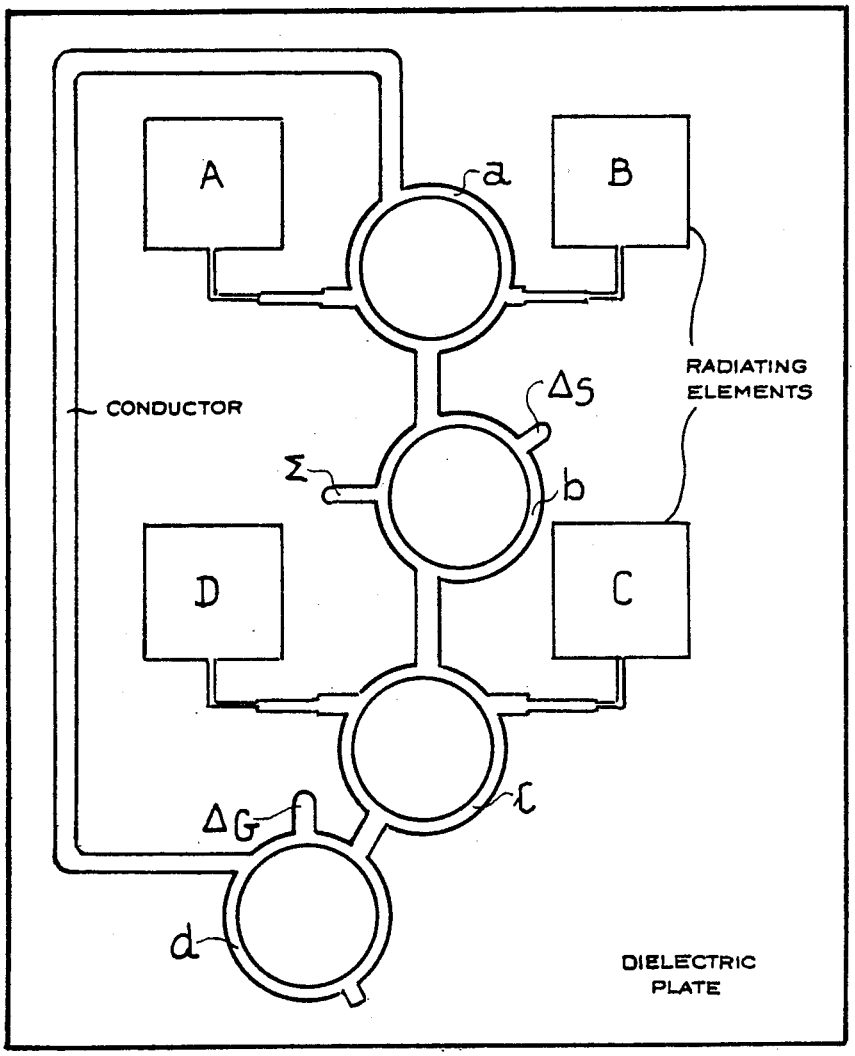
FIG 1 PRIOR ART
FIG. 1 is a top view of a printed monopulse source according to the prior art.
Figure 2:
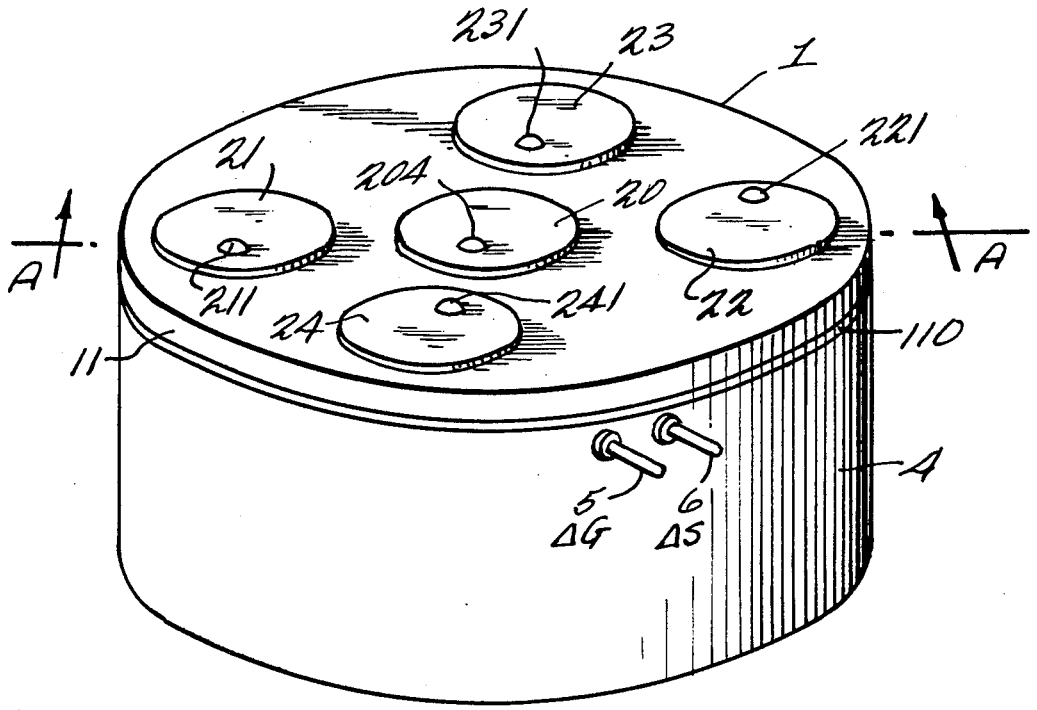
FIG. 2 is a perspective view of a primary source according to the present invention showing on the upper surface thereof a radiating circuit.
Figure 5:
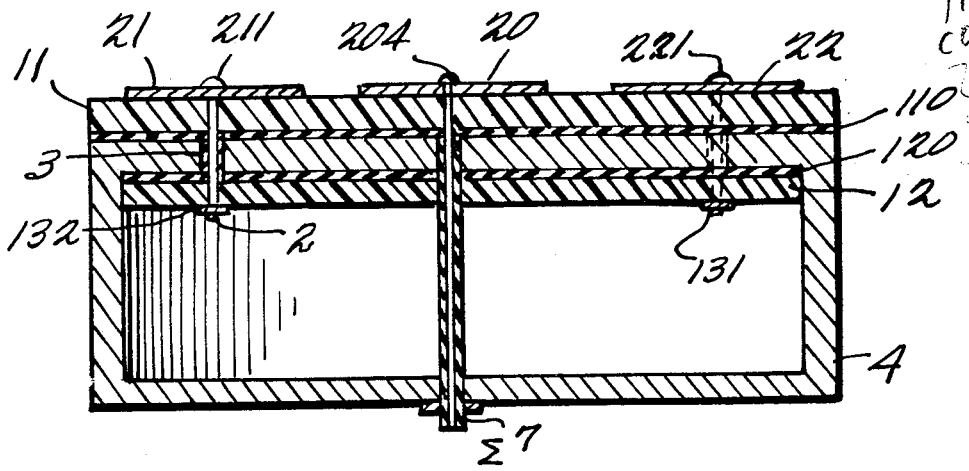
FIG. 5 is a cross-sectional view of the printed monopulse source shown in FIG. 2 assuming the incorporation of the second substrate embodiment feeding-/receiving circuit shown in FIG. 3.

Referring now to FIG. 2 there is shown a perspective view of the monopulse source according to the present invention. In FIG. 2, only a radiating circuit 1 is visible. However, radiating circuit 1 can be combined in the construction of FIG. 2 with any one of several alternative feeding/receiving circuits 2 shown in other Figures. Radiating circuit 1 is preferably a microstrip circuit. It is formed on a dielectric material substrate 11 having a conductive plate 110 on a lower side thereof providing a ground reference plane and provided with a plurality of conductive pads 20, 21, 22, 23 and 24. These conductive pads are the radiating element of radiating circuit 1. The pads are arranged as follows:

A central pad 20 forms the sum Σ channel. At least one pair of lateral pads (21 and 22) or (23 and 24), each pair being symmetrical with respect to central pad 20, forms one difference channel Δ. The radiating elements can have various shapes as will be further discussed with respect to FIGS. 7 and 8. The overall construction of the monopulse source according to the present invention and shown in FIG. 2, can incorporate any one of a plurality of feeding circuits 2. A second substrate embodiment of feeding circuit 2 is shown in top view in FIG. 3. Assuming the incorporation of the FIG. 3 feeding circuit, a cross-sectional view of FIG. 2 is shown in FIG. 5.

Figure 4:
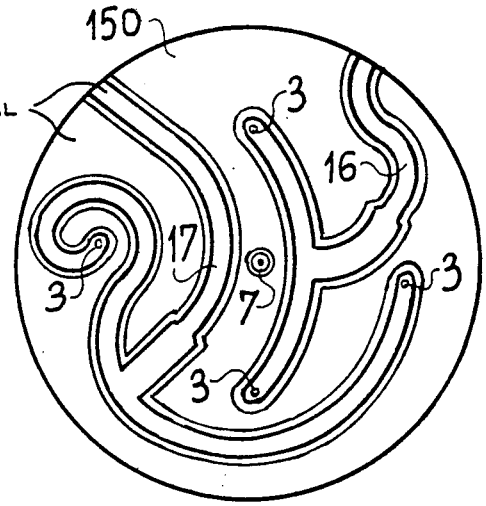
FIG. 4 is a top view of a coplanar embodiment of a feeding/receiving circuit for use with the radiating circuit shown in FIG. 2.
Figure 6:
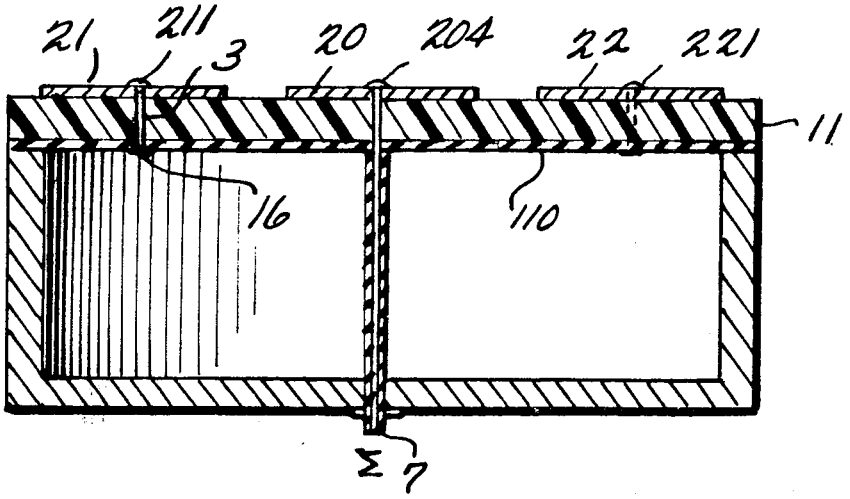
FIG. 6 is a cross-sectional view of the monopulse source shown in FIG. 2 assuming the incorporation of the coplanar embodiment feeding/receiving circuit shown in FIG. 4.
Figure 9:
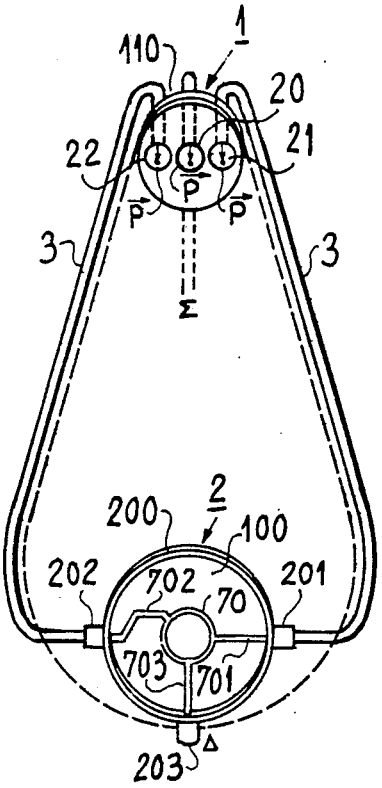
FIG. 9 is a first embodiment of a primary source according to the present invention using a hybrid junction feeding circuit.
Figure 10:
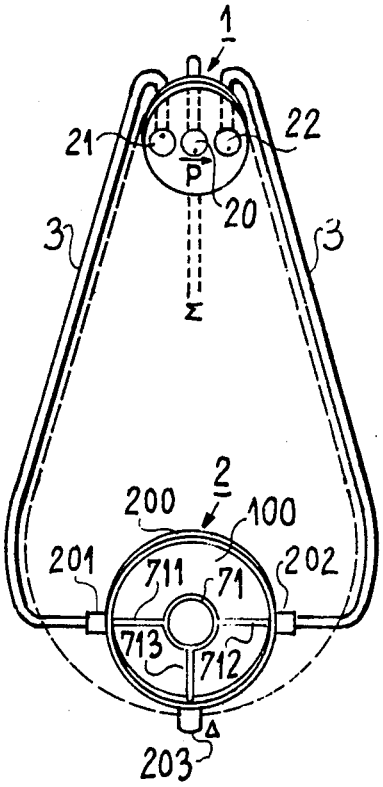
FIG. 10 is an alternate embodiment of the primary source according to the present invention using a hybrid feeding circuit.

A coplanar embodiment of feeding circuit 2 is shown in FIG. 4. Assuming the incorporation of the FIG. 4 embodiment into the construction generally shown in FIG. 2, a cross-section of the over-all construction would appear as shown in FIG. 6. The radiating circuits shown in FIGS. 2, 7 and 8 can also be fed by hybrid circuits as shown in FIGS. 9 and 10 to form an antenna of the general construction shown in FIG. 11. The various feeding circuit embodiments will be described in greater detail with reference to their respective Figures.

With continued reference to FIG. 2, showing the overall construction of the preferred embodiment of the present invention, radiating circuit 1 and feeding-/receiving circuit 2 (not visible in this FIGURE) are rigidly fixed to one another by a cylindrical metal casing 4. Substrate 11, carrying the radiating elements on the upper surface thereof is fitted on its lower circular wall with a conductive plate 110 in contact with metallic casing 4, held at ground potential. Of course, radiating elements 21, 22, 23, 24 and 20 are positioned outside of the grounded conductive frame formed by casing 4 and conductive plate 110. Feeding/receiving circuit 2 is contained within metallic casing 4 and is not visible in FIG. 2. Each of radiating elements 20–24 has associated with it a feed point 204, 211, 221, 231 and 241, respectively. Energy is coupled to these feed points via connecting means 3, also not visible in FIG. 2.

Central radiating pad 20 forms the radiating element for the sum channel Σ. Two pairs of lateral radiators (21, 22) and (23, 24) form the elevation difference channel ΔS and the azimuth difference channel ΔG, respectively. Thus, the three channels Σ, ΔS and ΔG are independent of one another, their radiation patterns being experimentally adjusted taking into account the couplings among the radiators. Coaxial access sockets 5 and 6 provide reception or feed points for the monopulse source. Sockets 5 and 6 are coupled to the ΔS and ΔG channels of feeding/receiving circuit 2. The feed point of central radiating pad 20 is directly connected through connecting means through a coaxial socket 7 shown in FIGS. 5 and 6 (not visible in FIG. 2), fitted on the lower circular bottom wall of metallic casing 4.

Figure 3:
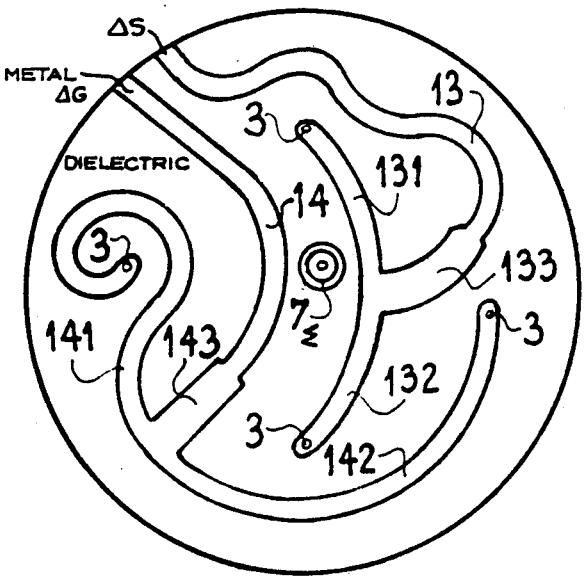
FIG. 3 is a top view of a second substrate embodiment of a feeding/receiving circuit for use with the radiating circuit shown in FIG. 2.

Referring now to FIG. 3 there is shown a top view of a second substrate embodiment for feeding/receiving circuit 2. FIG. 5 is a cross-section of FIG. 2 taken along line A—A assuming the second substrate embodiment feeding/receiving circuit has been incorporated into the overall construction shown in FIG. 2. The second substrate embodiment of feeding/receiving circuit 2 will be described with respect to FIGS. 3 and 5.

Feeding circuit 2 is fabricated on a second substrate 12 (vis a vis first substrate 11). The microstrip pattern shown in FIG. 3 is formed on a first face of dielectric substrate 12. The second face of substrate 12 is covered with a conducting plate 120 to form a reference ground plane. Substrate 11, on which radiating circuit 1 is formed, and substrate 12 on which feeding/receiving circuit 2 is formed are rigidly attached to one another back-to-back with their respective conducting plates in contact with both sides of the upper circular wall of metallic casing 4. Radiating circuit 1 is positioned toward the outside of the casing and feeding/receiving circuit 2 is oriented toward the inside of the casing. Feeding/receiving circuit 2 includes a T-shaped transmission line 13 forming the ΔS channel and a T-shaped transmission line 14 forming the ΔG channel.

Transmission line 13 includes branches 131 and 132 and transmission line 14 includes branches 141 and 142 of equal length. The end of each branch 131, 132, 141 and 142 is coupled through a connecting means 3 to an associated lateral radiating pad of radiating circuit 1. The connecting means 3 coupling energy from feeding-/receiving circuit 2 to radiating circuit 1, passes through the two parallel substrates 11 and 12 and conductive plates 110 and 120. The feeding/receiving end of a principal branch of the transmission lines 13 and 14 are connected directly to access sockets 6 and 5, respectively passing through the cylindrical wall of metallic casing 4. A feed point 204 of central radiator 20 is directly connected to socket 7 fixed on the lower circular surface of casing 4 through connecting means passing through substrates 11 and 12 and conductive plates 110 and 120. The length of lateral branches 131, 132 and the length of lateral branches 141 and 142 are experimentally determined so that the radiation patterns are optimized, i.e., so that the obtained radiation patterns have the best distribution around a focussing device associated with the monopulse source. The connecting means 3 are, for example, coaxial lines. T-shaped transmission lines 13 and 14 are for example strip lines, each line comprising an impedance transformer 133 and 143 respectively for transmission lines 13 and 14.

A physical prototype of the primary source according to the present invention was built and tested for operation in the "S" band. The operating wavelength being close to 10 cm. Including metallic casing 4, the source is a small cylinder approximately 13 cms in diameter and 6 cms high. The radiating elements are printed on a 5 mm thick dielectric material substrate fabricated from glass-epoxy resin laminate and having a dielectric constant of 4.5 and covered with copper on its two sides. Feeding/receiving circuit 2 is fabricated on a substrate of dielectric material marketed with the trademark "Rexolite" that is metallized on its two sides and has a thickness of 1.7 mm and a dielectric constant of 2.5.

The printed monopulse primary source shown in FIGS. 2, 3 and 5 operates as follows. The radiating elements 20–24 are positioned by taking into account the coupling therebetween so as to achieve the best results. The sum channel Σ corresponding to the central radiating element 20 radiates with a linear polarization according to a cosine radiation pattern modified by the couplings from the lateral radiators 21–24. The T-shaped transmission lines 13 and 14 of feeding circuit are selected to be of such a length that a part of the radiated energy, intercepted by the lateral radiators due to the coupling between the radiators and the transmission line, is conveyed to the two branches of the corresponding T-shaped transmission line where the two energy fractions are reflected due to their phase opposition.

This fraction of energy is radiated again by the lateral radiators which therefore take a part in forming the overall radiation pattern of the antenna, the T-shaped transmission lines thus forming the feeding/receiving circuit. For reception, lateral radiators 21–24 are fed by electromagnetic energy that has been previously reflected by an obstacle and impinges upon elements 20–24.

A second embodiment of feeding circuit 2 is shown in FIGS. 4 and 6. These Figures relate to a "coplanar" embodiment in which the feeding circuit is fabricated on the same substrate 11 on which the radiating circuit is formed. This embodiment is suitable for operation at frequencies in the "KU" band for wavelengths of approximately 1 cm because of the extremely simple construction.

In this embodiment, feeding/receiving circuit 2 is formed by coplanar lines on a first side of substrate 11. The second side of substrate carries radiating elements 20–24 forming sum channel Σ and elevation and azimuth difference channels ΔS and ΔG respectively. On the first side of substrate 11, two (2) T-shaped transmission lines 16 and 17 correspond to the two difference channels ΔS and ΔG respectively. Between lines 16 and 17 a conductive plate 110 covers the first face of the substrate 11 at a small distance around the lines making the dielectric material appear as four coplanar lines. The two branches of each T-shaped transmission line have equal lengths and their ends are respectively connected to the feed points of lateral radiators forming difference channels ΔS and ΔG through connecting means 3 passing through substrate 11 and conducting plate 110. Transmission lines 16 and 17 are respectively connected to sockets 6 and 5 passing through casing 4 which is directly welded to conductive plate 110.

Figure 7:
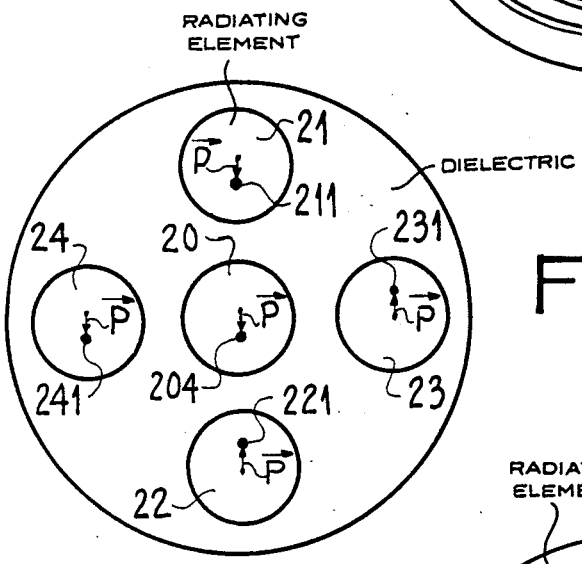
FIG. 7 is a top view of a first embodiment for the radiating circuit.

Referring now to FIG. 7, there is shown a top view of the radiating circuit illustrating the respective phases of the various radiating elements. The feed point of the two phase opposed fed resonators of a lateral pair is chosen so as to force one difference channel ΔS or ΔG. The feed points of the two pairs 21, 22 and 23, 24 are respectively referred to by reference numerals 211, 221 and 231, 241. The feed point is a particular point of the radiating element which has a certain eccentricity e with respect to the zero-field radio center of each radiator in the axis of polarization defined by the eccentricity of the feed point of the central radiator.

In the FIG. 7 embodiment, the radiators are round metallized capsules having the same diameter and printed on the dielectric substrate. In this case, the zero-field radio center of each radiator coincides with the geometrical center of the radiator. The arithmetical value of the eccentricity characterizes the impedance of the corresponding radiator.

Two radiators of the pair form a difference channel having feed points with opposed eccentricity, the eccentricity being measured in magnitude and in value with respect to the eccentricity of the central defining the axis of polarization. In FIG. 7 the axis of polarization is shown for each radiator by a vector P, the origin of which is the radio center of the radiator and the extremity of which is at the feed point of the radiator. For receiving a signal, the lateral radiators of each pair form an elevation of azimuth difference channel supply phase-opposed signals due to the equally long branches of each T-shaped transmission line up to their respective junctions. Thus, the phase opposition of the signals in each different channel is indepdendent of frequency. The operating frequency range of the primary source is only limited by the radiators themselves and by the T-shaped line. The voltage standing wave ratio (VSWR) of which is only acceptable for a predetermined frequency range. The choice of transmission lines 16, and 17 having the same electrical length up to sockets 6, 5 allows the signals to be substantially in phase. The various embodiments considered thus far include round radiating elements 20–24. However, without departing from the spirit of the present invention, other geometrical shapes can be utilized.

Figure 8:
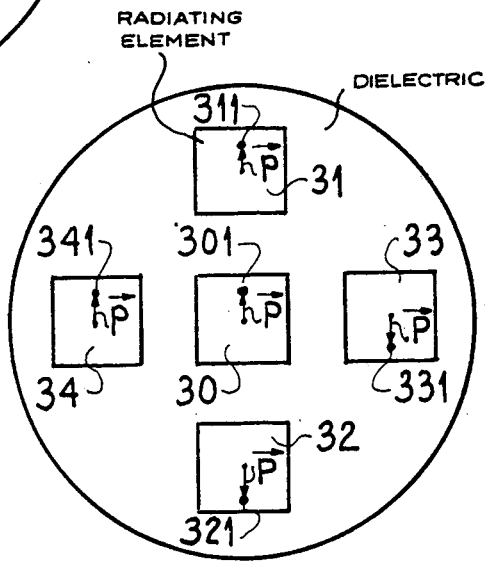
FIG. 8 is a top view of a second embodiment for the radiating circuit.

Referring now to FIG. 8 there is shown a radiating circuit 1 utilizing square radiating elements 20–24. These radiating elements are metallized capsules as were the round radiating elements shown in FIG. 7. All the radiating elements have identical dimensions. In this embodiment, the axis of polarization is also shown as a vector P, the origin of which coincides with the radio center of the corresponding radiator and the extremity of which coincides with the feed point of the respective radiator. In every case the eccentricity e of the feed point of each lateral radiator is preferably determined in a parallel direction to the eccentricity of the feed point of the central radiator.

Referring now to FIG. 9 there is shown an alternate embodiment of the printed monopulse source according to the present invention. This embodiment comprises a central radiator 20 forming the sum channel Σ and one pair of lateral radiators 21 and 22 forming one difference channel Δ. The lateral radiators 21 and 22 are symmetrical with respect to central radiator 20. The feeding/receiving circuit 2 corresponds to the pair of lateral radiators in the general case to each pair of lateral radiators there is a single hybrid circuit 70 having two de-coupled asymmetrical inputs 701 and 702 in phase opposition.

The hybrid circuit is fabricated on a dielectric material substrate 12 independent of dielectric substrate 11 carrying the radiating elements forming a radiating circuit. Dielectric substrate 12 is, for example, mounted on a metal casing 200 insuring mechanical stability of the feeding/receiving circuit. Each input 701 and 702 is connected by means of sockets 201 and 202 respectively of the coaxial type and fixed to casing 200. These sockets are coupled to a lateral radiator 21 or 22 through connecting means 3 having equal electrical lengths. The difference channel can be obtained at an output 703 coupled to a socket 203. The central radiating zone 20 is coupled directly to an output of the radar transmitter or receiver branching system. Connecting means 3 are preferably formed by a coaxial cable, the central conductor of which is connected to an input 701 or 702 of hybrid circuit 70 and to feed point of each lateral radiator 21, 22 of the pair. The external conductor of each coaxial cable constituting a connecting means 3 is coupled to the casing 200 of substrate 12 and to the conductive plate 110 of substrate 11 by means of a socket 201 or 202 and of coaxial sockets (not shown in FIG. 7) directly welded to the conductive plate 110 of substrate 11.

According to the embodiment of FIG. 7, the excitation points of each lateral radiator of the pair has the same eccentricity e, the phase opposition making it possible to form the corresponding difference channel being provided at the hybrid circuit 70.

The scope of the present invention includes embodiments having different numbers of lateral radiators and different numbers of hybrid circuits to form more than one difference channel and in which the phase opposition makes the algebraic sum of the corresponding signals possible is obtained by different solutions.

In particular, according to the embodiment in FIG. 10, the feeding/receiving circuit of the lateral radiators of a pair is constituted by one hybrid circuit 71 arranged on an independent dielectric material substrate having two in-phase symmetrical inputs 711, 712 connected through sockets 201, 202 respectively to the lateral radiators 21, 22 respectively of a pair forming one difference channel. The difference signal is obtained on a channel 713 connected to a socket 203. The connector means 3 ensuring the electrical connection of the radiators with the feeding/receiving circuit are connected to the feedpoint of each radiator.

The two feedpoints of a pair forming a difference channel have, according to FIG. 10, opposite eccentricities, the eccentricity being measured in magnitude and in sine compared with the eccentricity of the central radiating zone defining the polarization direction of the radio signal transmitted by the primary source. The two lateral radiators 21 and 22 supply signals in phase opposition to the hybrid circuit 71 and form a difference channel.

The embodiments shown in FIGS. 9 and 10 permit a complete decoupling of the transmission-feeding-reception modes and a better decoupling of the channels, as a result of the complete separation of the feeding/receiving circuit and of the radiating circuit of the source.

Figure 11:
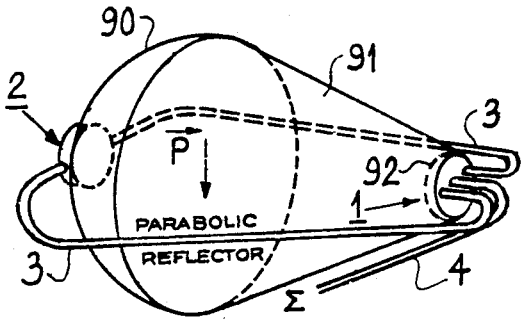
FIG. 11 is a perspective view of a radar antenna comprising a primary source according to the present invention as shown in either the FIG. 9 or 10 embodiments.

According to a preferred embodiment of the antenna according to the invention, shown in FIG. 11, the antenna includes a parabolic reflector 90. The radiating circuit 1 of the primary source is provided at the focus of said reflector 90 and is held in position by a frustum-shaped part 91, fixed to the reflector. The frustum-shaped part 91 covers the reflector opening and is, for example, fitted into said opening and fixed to said reflector by an appropriate means. A recess is provided at the apex of the frustum-shaped part 91 for receiving the radiating circuit 1 of the primary source, the radiators forming the independent sum and difference channels facing the reflector. The frustum-shaped part 91 is made of a dielectric material having a dielectric constant lower than 1.1, e.g. a polyurethane foam.

The feeding/receiving circuit 2 which, together with radiating circuit 1 forms the primary source, is fixed at the back of the reflector. Coaxial cables constituting connecting means 3 which connect the feeding/receiving circuit 2 to the radiating circuit 1, as described and shown, for example, in FIG. 7 or 8. The semi-rigid coaxial cables ensure the mechanical stability of the assembly of the radiating circuit 1, of the frustum-shaped part 91 and of the reflector 90. The coaxial cables are preferably arranged along generating lines of the frustum-shaped part and orthogonally to the axis of polarization represented by the vector P. The scope of the present invention includes embodiments in which the primary source or the radiating circuit of the primary source is offset with respect to the focus of the radar antenna reflector.

In any embodiment of the present invention, the simplicity of the feeding/receiving circuit makes it possible to obtain low losses, as the integrated feeding/receiving circuit and the radiating integrated radiating circuit provided on the opposite faces of a dielectric substrate or on separate dielectric substrates and the separation of the sum and difference channels make it possible to minimize said losses. The circuits of the monopulse primary source according to the invention can be produced by photogravure. The feeding and radiating circuits can be obtained with a great precision at little cost and with small dimensions as compared with conventional sources.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

We claim:

1. A monopulse primary source comprising:

a microstrip radiating circuit comprising:

a dielectric material substrate having first and second faces;

a conductive coating provided on said first face for forming a reference ground plane;

a central microstrip radiating element provided on said second face for forming a sum channel;

at least one pair of radiating elements, provided on said second face and being symmetrical with respect to the central radiating element for supplying, on reception, signals which are 180° out of phase for forming one difference channel;

each radiating element having a feedpoint associated therewith, the feedpoint having a predetermined eccentricity with respect to the zero field radio center of its respective radiating element in the axis of polarization defined by the eccentricity of the feedpoint of the central radiating element;

a feeding/receiving circuit; and connecting means for coupling the feedpoints of said radiating elements to said feeding/receiving circuit.

2. A primary source according to claim 1, wherein said feeding/receiving circuit comprises: a second dielectric material substrate having first and second faces, the first face of which is covered with a conductive coating for forming a reference earth and the second face of which is provided with a microstrip circuit providing coupling points for connection to the feedpoints of the radiating elements.

3. A primary source according to claim 2, wherein said feeding/receiving circuit includes, for each pair of lateral radiators forming a difference channel, a T-shaped transmission line, having a main branch connected to an access socket and a pair of secondary branches having equal length and being connected respectively by the connecting means to their respective feedpoints of corresponding radiating elements of said pair, the feedpoints of said pair having opposed eccentricities, the connecting means to the central radiator being directly connected to an access socket.

4. A primary source according to claim 3, wherein said T-shaped transmission line is a stripline, the main branch of which comprises an impedance transformer.

5. A primary source according to claim 2, wherein said feeding/receiving circuit for each pair of lateral radiators forming a difference channel, comprises a hybrid circuit having two inputs connected respectively to the feedpoints of the two radiating elements of said pair by connecting means, the connecting means to the central radiator being directly connected to an access socket and the difference channel being delivered by an output of the hybrid circuit.

6. A primary source according to claim 5, wherein the two inputs of the hybrid circuit are 180° out of phase and connected respectively by connecting means having the same electrical length to each radiator of the corresponding pair to be fed, the two feedpoints of said pair having the same eccentricity.

7. A primary source according to claim 5, wherein the two inputs of the hybrid circuit are in phase symmetrical inputs and are connected respectively by connecting means having the same electrical length to each radiator of the corresponding pair to be fed, the two feedpoints of said pair having opposed eccentricities.

8. A primary source according to claim 1, wherein the feeding/receiving circuit is provided together with the conductive area on the first face of the dielectrical material substrate, the second face of which carries the radiating elements, and comprises, for each pair of lateral radiations, a T-shaped transmission line, having a main branch connected to an access socket, and having secondary branches of equal length connected to the feedpoint of the lateral radiators of the pair and which forms, together with the bordering conductive area, a coplanar transmission line, the connecting means of the central radiator being directly connected to a feeding socket.

9. A primary source according to claim 1, 2, 3, 4, 5, 6, 7 or 8, wherein the connecting means are connected perpendicularly to the radiating elements at their feedpoint through the substrate carrying said radiators.

10. A primary source according to claim 1, 2, 3, 4, 5, 6, 7 or 8, wherein the connecting means between the radiating elements and their feeding/receiving circuit are coaxial cables, the access sockets being coaxial sockets.

11. A primary source according to claim 1, 2, 3, 4, 5, 6, 7 or 8, wherein the radiating elements are round metallized capsules.

12. A primary source according to claim 1, 2, 3, 4, 5, 6, 7 or 8, wherein the radiating element are square metallized capsules.

13. A radar antenna comprising:

a microstrip radiating circuit comprising:

a dielectric material substrate having first and second faces;

a conductive coating provided on said first face of said substrate for forming a reference ground plane;

a central radiating element provided on said second face of said substrate for forming the sum channel;

at least one pair of radiating elements, the elements of which pair are provided on said second face of said substrate symmetrically with respect to the central radiator for supplying, on reception, signals in phase opposition forming one difference channel;

each radiating element including a feedpoint having a predetermined eccentricity with respect to the zero field radio center of its respective radiating element in the axis of polarization defined by the eccentricity of the feedpoint of the central radiator which is directly connected to a feed socket by connecting means;

a printed feeding/receiving circuit coupled to said pair of lateral radiations;

connecting means for coupling the feedpoints of said radiating elements to said feeding/receiving circuit;

a parabolic reflector, at the focus of which the substrate carrying the radiating elements is positioned; and a frustum-shaped part fixed to the reflector and covering its opening, for holding said substrate in position at the apex of the frustum-shaped part, with the radiating elements facing the reflector.

14. A radar antenna according to claim 13, wherein the receiving feeding circuit of the lateral radiators of a pair is printed on the second face of a second dielectric material substrate, the first face of which is covered with a conductive coating.

15. A radar antenna according to claim 14, wherein said second substrate carrying the feeding/receiving circuit is fitted at the back of the reflector.

16. A radar antenna according to claim 15, wherein the connecting means between the feeding/receiving circuit and the radiating elements are semi-rigid coaxial cables along generating lines of the frustum-shaped part and orthogonally to the axis of polarization of the electrical field of the signal transmitted by the primary source.

17. A radar antenna according to claim 13, wherein the feeding/receiving circuit of the lateral radiators of a pair is printed on the first face of the substrate carrying the radiating elements on its second face and forming together with the bordering conductive coating a coplanar type circuit.

18. A radar antenna according to claim 13, 14, 15, 16 or 17, wherein the connecting means are connected perpendicularly to the radiating elements at their feedpoint.

19. A radar antenna according to claim 13, 14, 15, 16 or 17, wherein the frustum-shaped part is made of a dielectrical material having a dielectric constant lower than 1.1.

* * * * *